US008534240B1

(12) United States Patent
Waissi et al.

(10) Patent No.: US 8,534,240 B1
(45) Date of Patent: Sep. 17, 2013

(54) ALTERNATIVE CRANKDISK BEARING SUPPORT FOR THE WAISSI INTERNAL COMBUSTION ENGINE

(71) Applicants: Gary Ray Robert Waissi, Phoenix, AZ (US); Robert Waissi, Ann Arbor, MI (US)

(72) Inventors: Gary Ray Robert Waissi, Phoenix, AZ (US); Robert Waissi, Ann Arbor, MI (US)

( * ) Notice: Subject to any disclaimer, the term of this patent is extended or adjusted under 35 U.S.C. 154(b) by 0 days.

(21) Appl. No.: 13/896,238

(22) Filed: May 16, 2013

(51) Int. Cl.
*F02B 75/22* (2006.01)

(52) U.S. Cl.
USPC ..... 123/55.3; 123/197.4; 123/55.2; 123/55.4; 74/48; 74/51; 74/54

(58) Field of Classification Search
USPC ..... 123/55.3, 197.4, 55.2, 55.5, 55.7, 123/56.8; 74/48–51, 54, 55, 567, 568 R, 74/570.3; 384/11, 50, 58
See application file for complete search history.

(56) References Cited

U.S. PATENT DOCUMENTS

| | | | | |
|---|---|---|---|---|
| 4,682,569 | A * | 7/1987 | Stiller et al. | 123/54.2 |
| 5,402,755 | A | 4/1995 | Waissi | |
| 5,660,151 | A * | 8/1997 | Yoshizawa | 123/63 |
| 6,082,314 | A * | 7/2000 | Li et al. | 123/55.4 |
| 7,334,558 | B2 * | 2/2008 | Higgins | 123/197.4 |
| 8,109,244 | B1 | 2/2012 | Waissi | |
| 2009/0013681 | A1 * | 1/2009 | Courtright | 60/327 |
| 2011/0023815 | A1 * | 2/2011 | Schneeberger | 123/241 |

OTHER PUBLICATIONS

Waissi, Gary R., Internal Combustion (IC) Engine with Minimum Number of Moving Parts, Paper No. 950090, Futuristic Concepts in Engines and Components, 1995, pp. 61-64, SAE SP-1108. Published by SAE, United States.

U.S. Appl. No. 13/742,318, Gary R. Waissi and Robert Waissi, Crankdisk Bearing Support for the Waissi Internal Combustion Engine; filed Jan. 15, 2013. (unpublished).

* cited by examiner

*Primary Examiner* — Noah Kamen
*Assistant Examiner* — Long T Tran

(57) ABSTRACT

An improvement to the Waissi type opposed piston internal combustion (IC) engine is proposed. The engine has at least one pair of aligned and opposed cylinders with one reciprocating double-headed piston assembly in each cylinder pair. The reciprocating motion of the piston is transmitted to the driveshaft by a rotating crankdisk, which is off-centered mounted to the driveshaft. The high friction metal to metal contact between the crankdisk and the piston contact wall is replaced by a combination of a roll resistance and friction under hydrodynamic conditions resulting to a significantly reduced total resistance between the piston and the crankdisk. This is accomplished by utilizing a bearing ring assembly slidably installed on the annular perimeter surface of the crankdisk. When the crankdisk rotates the bearing ring is held in its designed place in a slot bounded laterally only by the connecting members of the integrated double-headed piston assembly.

1 Claim, 6 Drawing Sheets

K - K

K - K

L - L

ALTERNATIVE CRANKDISK BEARING SUPPORT FOR THE WAISSI INTERNAL COMBUSTION ENGINE

FIELD OF THE INVENTION

This invention relates to an internal combustion (IC) engine, and more particularly to the prior art reciprocating IC engine with opposed and aligned cylinders proposed by Waissi, U.S. Pat. No. 8,109,244 B1 and U.S. Pat. No. 5,402,755, and application Ser. No. 13/742,318, as well as disclosed in SAE SP-1108 paper No. 950090.

BACKGROUND OF THE INVENTION

The prior art engine (U.S. Pat. No. 8,109,244 B1 and U.S. Pat. No. 5,402,755, and U.S. patent application Ser. No. 13/742,318) is an internal combustion engine with opposed and aligned cylinders, called here the Waissi Engine. The Waissi Engine consists of at least one pair of aligned and opposed cylinders wherein a reciprocating double-headed piston is slidably mounted, and in which the double-headed piston axis intersects perpendicularly with the axis of a driveshaft. The reciprocating motion of the double-headed piston is transmitted to the driveshaft by a rotating crankdisk. The crankdisk is mounted off-centered to the driveshaft, which is rotably mounted to a crankcase. The crankdisk outer perimeter is annular forming a circle. The double-headed piston has two slots perpendicularly through its axis, one of which is to allow for a rotating movement of the crankdisk, and the other, to allow for the rotation of the driveshaft. The prior art further discloses that the double-headed piston may be assembled from multiple components or parts, which form an integrated, rigid, piston structure.

In conventional prior art engines (V-, in-line, opposed) the metal to metal contact between the piston connecting-rod big-end and the crankshaft is avoided by creating hydrodynamic lubrication conditions in an oil film of the connecting-rod to crankshaft bearing (journal bearing). It is therefore, and in order to reduce friction and wear, highly desirable to create similar hydrodynamic lubrication conditions in the piston to crankdisk contact surface of the Waissi Engine, and, in particular, to provide for crankdisk rotation under hydrodynamic conditions.

The prior art improvement (SAE SP-1108, Paper No. 950090, Futuristic Concepts in Engines and Components, pp. 61-64, (1995)) to the Waissi Engine propose to reduce friction between the crankdisk annular bearing surface and piston internal bearing surfaces by a special bearing ring. Within this improvement the outer perimeter surface of the crankdisk acts as a bearing and slides inside the bearing ring. The crankdisk has a diameter and annular perimeter design that fits tightly but slidably inside the bearing ring. The bearing ring, with a diameter that fits in-between the piston slot bearing surfaces (or inside the piston slot), is intended to roll or slide on the piston slot bearing surface. The crankdisk perimeter and surface design correspond the conventional engine crankshaft-piston rod journal design to provide for hydrodynamic lubrication.

The prior art (U.S. Pat. No. 8,109,244 B1) improvement discloses specific designs for the crankdisk and bearing ring to provide for assembly as well as for holding the bearing ring in its designed location when the crankdisk rotates. The bearing ring is installed on the crankdisk to provide for hydrodynamic lubrication conditions between the crankdisk and the bearing ring, and for oil-splash lubrication between the bearing ring and the piston slot surface.

The prior art (U.S. Pat. No. 8,109,244 B1) discloses two specific distinct designs for the crankdisk-bearing combination. One of the designs consists of a machined or casted groove or depression on the crankdisk outer annular surface, in which one or both of the flanges or sides of the groove of the crankdisk are removable to allow for a flat I-profile bearing ring installation such that the bearing ring fits tightly but slidably in-between the flanges of the crankdisk annular bearing surface. The second, or alternative, design consists of a machined or casted groove on the inside surface of the bearing ring, forming a U-profile with flanges facing toward the center of the bearing ring, in which one or both of the flanges or sides of the groove are removable to allow for the U-profile bearing ring installation such that the crankdisk bearing surface fits tightly but slidably in-between the bearing ring flanges. Both designs propose modifications in form of casting or machining a U-profile on either the inside surface of the bearing ring or the annular outside surface of the crankdisk with one or both flanges or sides removable respectively. Both proposed designs provide for assembly as well as for holding the bearing ring in its designed location when the crankdisk rotates. Both proposed designs also provide for hydrodynamic lubrication condition between the crankdisk annular bearing surface and the bearing ring.

The prior art (application Ser. No. 13/742,318, Jan. 15, 2013) discloses a design, in which the linear bearing surface of the piston slot wall is provided with flanges (a U-shaped groove) to hold the bearing ring in its designed position, when the crankdisk rotates. In the proposed design the flanges are fixed, as the two piston heads are assembled together to form an integrated rigid piston structure. The proposed design provides for assembly as well as for holding the bearing ring in its designed location when the crankdisk rotates. The proposed design also provides for hydrodynamic lubrication condition between the crankdisk annular bearing surface and the bearing ring.

However, as summarized above, the prior art proposes only a bearing ring-crankdisk combination design that will require machining or casting a groove or depression on either the inside surface of the bearing ring or the outer annular surface of the crankdisk with one or both flanges removable to provide for assembly, or machining or casting a groove (with flanges) on the linear bearing surface of the piston slot wall to hold the bearing ring in its designed place when the crankdisk rotates. The prior art proposed solutions include also an alternative utilization of roller- or ball bearings instead of a bearing ring. However, roller-, ball and other direct contact (metal-to-metal, or other direct solid material contact) bearings are not the subject of this invention.

BRIEF SUMMARY OF THE INVENTION

A main object of the present invention is to provide an improvement to the Waissi Engine, which significantly simplifies the manufacture, assembly and installation of the prior art bearing ring, crankdisk and integrated piston assembly without affecting the operational hydrodynamic lubrication condition between the bearing ring and the annular outer surface of the crankdisk. The invention comprises the features hereinafter described and particularly pointed out in the claims. The following description and the attached drawings set forth in detail certain illustrative, however indicative, embodiment of the invention, of but a few ways in which the principles of the invention may be employed.

The main object of this invention is accomplished by utilizing the connecting members, or structures, installed on both sides of the integrated double-headed to hold the bearing ring in place when the crankdisk rotates. While accomplishing the same objective as the prior art, the proposed design does not require grooves or flanges on the crankdisk, or the bearing ring, or the piston slot wall. The invention is accomplished by utilizing at least two connecting members, or structures, attached to the sides of the double-headed piston to form the integrated piston structure, and at the same time using the said connecting members to hold the bearing ring in its designed place when the crankdisk rotates. Within this arrangement a flat I-profile bearing ring, in which the surface of the base of the bearing ring is flat and smooth, corresponding to prior art bearing surface design, on both sides and parallel to the crankdisk bearing surface, is used. The bearing ring is manufactured as one piece without a groove for assembly or a removable flange. The crankdisk annular surface is also manufactured without a groove or removable flange for the bearing ring. Similarly, the linear bearing surface of the piston slot wall is manufactured without a groove or flanges. Within the proposed design the outer perimeter of the flat, I-profile, bearing ring fits, allowing a small lateral movement, and is allowed to slide or roll on the linear bearing surface of the piston slot wall. Within the proposed design, also, the flat I-profile inner perimeter of the bearing ring fits tightly but slidably on the crankdisk, and slides under hydrodynamic conditions on the crankdisk annular perimeter surface. There is neither a groove nor flanges required on the crankdisk to hold the bearing ring or to provide for assembly. And, there is neither a groove nor flanges required on the crankdisk to hold the bearing ring or to provide for assembly. And also, there is neither a groove nor flanges required on the sides of the linear bearing surfaces of the piston slot walls to hold the bearing ring in place when the crankdisk rotates.

BRIEF DESCRIPTION OF THE SEVERAL VIEWS OF THE DRAWINGS

The main object, features and advantages of this invention will become apparent from a consideration of the following description, the appended claims and the accompanying drawings in which:

FIG. 2*a* also identifies the piston mantel 1, piston support structure 1A, piston support structure flange 1B for attachment of the connecting frame 6, connecting bolts 6A, and the linear bearing surface of the piston slot wall 4. Other parts and components are not shown for clarity.

FIG. 2*c*-1, FIG. 2*c*-2, and FIG. 2*c*-3. FIG. 2*c*-1 shows the top-view section K-K of FIG. 2*a*, FIG. 2*c*-2 shows the same top-view section K-K and includes a dashed circle. The dashed circle represents the top-view section L-L of FIG. 2*a*. Section L-L is shown enlarged in FIG. 2*c*-3. Other parts and components are not shown for clarity.

FIG. 2*c*-1 shows the top-view section K-K of FIG. 2*a*. This figure shows the piston mantel 1, piston support structure 1A, flange 1B of the piston support structure for attachment of the connecting frame 6, piston support structure bearing surface side wall 1C, connecting bolts 6A, and the piston slot bearing surface wall 4. The figure also shows the two piston head connecting frames 6 attached to opposite sides of the linear bearing surface of the piston structure. The figure also shows the driveshaft 2, crankdisk 3, and the bearing ring 3A. The bearing ring 3A fits slidably, allowing for a small lateral movement, in-between the piston connecting frames 6. The connecting frames 6, attached rigidly to the piston sub-structure utilizing flanges 1B and connecting bolts 6A, are tightly attached against the piston substructure side wall 1C. The inside (bearing ring side) surfaces of the connecting frames 6 hold the bearing ring in its designed position when the crankdisk rotates. There are no grooves or flanges on the bearing ring 3A, the crankdisk 3 bearing surface, or the linear bearing surface of the piston slot wall for the purpose of holding the bearing ring 3A in its designed place when the crankdisk rotates. It should be noted, that if a groove is created for the purpose of oil distribution either on the bearing ring or the crankdisk bearing surface, then that does not constitute a different invention. The detail is further shown in FIG. 2*c*-3 with an enlarged top view of section L-L.

DETAILED DESCRIPTION OF THE INVENTION

Figure 1:
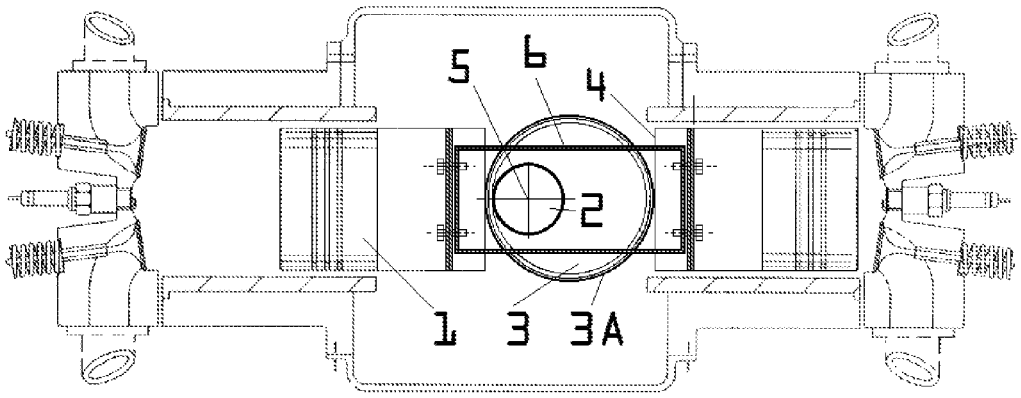
FIG. 1 (adapted from U.S. Pat. No. 8,109,244 B1, U.S. Pat. No. 5,402,755 and from SAE SP-1108, Paper No. 950090, Futuristic Concepts in Engines and Components, pp. 61-64, (1995)) is a section view of the Waissi Engine, in which a double-headed piston 1 reciprocates, perpendicularly to a driveshaft 2, in aligned and horizontally opposed cylinders. The rigid double-headed piston assembly consists of two piston heads attached to each other by two connecting members, or (frame) structures, 6 (one of those is shown in FIG. 1). These two connecting members are rectangular frames, each end of which is attached to the side of the piston head substructure. It is noted that at least one connecting member is required between the piston heads to integrate the two piston heads into one piston structure. Therefore, a different number of connecting members between the piston heads, or a different design, that accomplish the same objective of creating an integrated piston structure, does not create a different invention. The connecting members provide two slots perpendicularly through the axis of the pistons, one of which is to allow for a rotating movement of the crankdisk 3 and the bearing ring 3A combination, and the other slot, to allow for the rotation of the driveshaft 2. The crankdisk 3 bearing ring to piston slot wall linear contact surface is identified as 4 in FIG. 1. Other parts and components are not shown for clarity.

In FIG. 1 (adapted from U.S. Pat. No. 8,109,244 B1, U.S. Pat. No. 5,402,755 and from SAE SP-1108, Paper No. 950090, Futuristic Concepts in Engines and Components, pp. 61-64, (1995)) the double-headed piston 1 reciprocates, perpendicularly to the driveshaft 2, in the aligned and horizontally opposed cylinders. The driveshaft 2 is rotably mounted to the crankcase. The center axis 5 of the driveshaft is the center of rotation of the driveshaft. The crankdisk 3 is off-centered attached to the driveshaft 2. The crankdisk 3 is located at the piston axis.

The outer annular perimeter surface of the crankdisk 3 acts as a bearing and slides under hydrodynamic conditions inside the bearing ring 3A, which rolls or slides on the linear bearing surface of the piston slot wall 4. The piston slot of the integrated double-headed piston is axially provided through the piston 1 to allow for the rotation of the crankdisk 3. Hydrodynamic conditions are created by oil being pumped under pressure through channels or cavities provided through the crankdisk connecting the center of the driveshaft oil supply to the outer perimeter bearing surface of the crankdisk.

To force rolling of the bearing ring on the linear bearing surface of the piston slot wall 4 the outer perimeter surface of the bearing ring 3A, and the piston slot wall, may be provided with appropriate toothing or gear. This, forced rolling of the bearing ring via toothing or gear, however, is not necessary, does not provide for additional benefits, and does not constitute a different invention.

The crankdisk 3 has a diameter that fits tightly but slidably inside the bearing ring 3A, which fits tightly but slidably between the linear bearing surfaces of the integrated double-headed piston bearing surfaces. The crankdisk 3 has a perimeter design, known from the prior art, that provides for hydrodynamic lubrication conditions between the crankdisk 3 and the bearing ring 3A. The inside distance between the linear bearing surfaces of the two integrated piston heads is such that it will accommodate the crankdisk 3 and the bearing ring 3A including an acceptable tolerance known from the prior art.

Figure 2A:
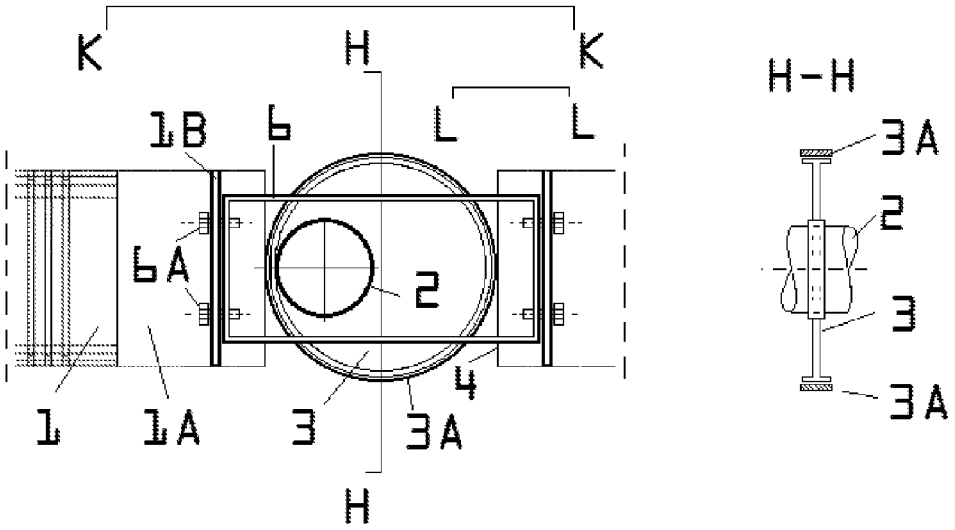
FIG. 2*a* shows the center section of the engine of FIG. 1, as well as the cross section H-H of the crankdisk 3—bearing ring 3A—drivehaft 2 assembly.
Figure 2B:
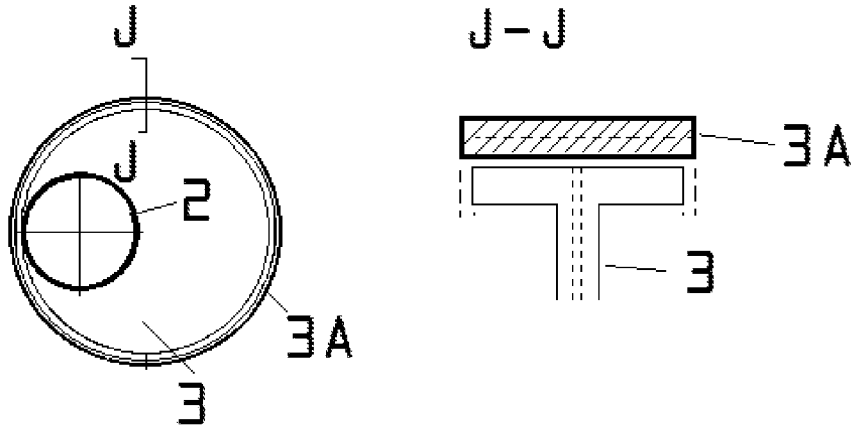
FIG. 2*b* shows separately the crankdisk 3, bearing ring 3A, drive shaft 2 assembly, and identifies the cross section J-J. Section J-J shows an enlarged view of the cross section of the top part of the crankdisk 3 bearing ring 3A interface. It is noted, that FIG. 2*b* shows no machined or casted grooves to laterally support the bearing ring 3A to hold the bearing ring in its place when the crankdisk rotates. It is also noted, that the bearing ring 3A is shown to be wider than the crankdisk annular bearing perimeter surface for the purpose of allowing a small lateral movement of crankdisk.
Figures 1, 2C:
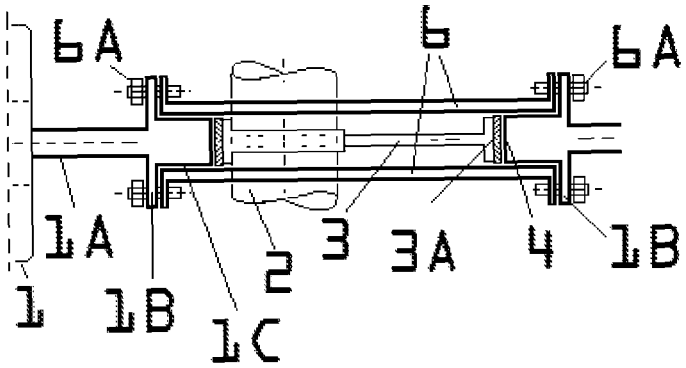
FIG. 2*c* is presented as three related figures.
Figures 2, 2C:
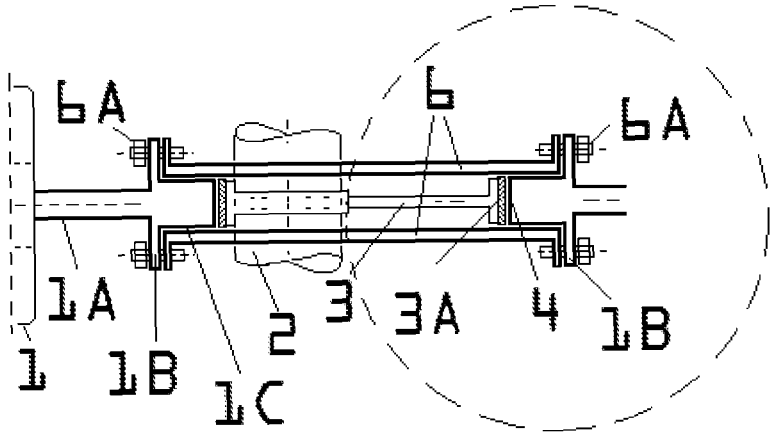
Figures 2, 2C, 3:
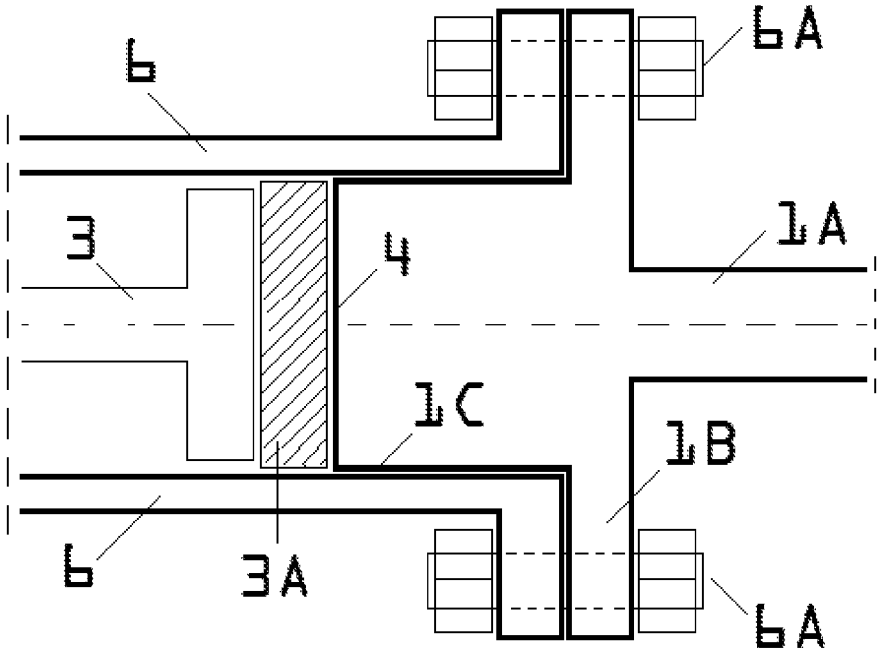

In the preferred embodiment a flat, I-profile, bearing ring 3A is installed on the crankdisk as shown in FIG. 2*a* and FIG. 2*b*. FIG. 2*b* also shows that there are no means of holding (grooves or flanges on the piston bearing slot surface, bearing, or crankdisk) the bearing ring in its designed position when the crankdisk rotates. The means of holding the bearing ring in its designed position is accomplished directly by the piston head connecting members (structures or frames) 6 attached to the sides of the piston sub-structure 1A, shown in FIG. 2*c*; FIG. 2*c*-1, FIG. 2*c*-2, FIG. 2*c*-3. FIG. 2B, cross-section J-J, also shows that the bearing ring 3A is wider than the crankdisk 3 bearing surface for the purpose of allowing for a small lateral movement of the crankdisk on the driveshaft 2 without reducing the effective size of the bearing surface.

The proposed design has the following benefits when compared to the prior art (U.S. Pat. No. 8,109,244 B1 and application Ser. No. 13/742,318) design: fewer parts, simpler design, simpler manufacturing and easier assembly. In the proposed design the piston slot bearing surface is linear and does not require grooves or flanges. The prior art solutions require a removable annular (circle or ring) flange or side on the bearing ring or the crankdisk to allow for bearing ring-crankdisk combination assembly, or flanges on the sides of the linear bearing surface on the piston slot wall. The proposed design combines the use of the piston head connecting members for both the purpose of creating an integrated piston structure, and for utilizing the said connecting members for holding the bearing ring in its designed position when the crankdisk rotates. The proposed design accomplishes both the same hydrodynamic lubrication objective between the crankdisk and the bearing ring, and the holding of the bearing ring in its designed position as the prior art solutions, but without additional grooves, flanges, or dedicated piston integration support structures.

Without loss of generality, different piston head connecting member designs and arrangements that form a rigid double-headed piston and provide for keeping the bearing ring in its designed position when the crankdisk rotates do not change the bearing ring function, do not change the bearing ring to crankdisk lubrication arrangement, do not change the function of the integrated double-headed piston assembly, and, therefore, do not constitute a different invention.

For clarity and simplicity, significant engine parts are shown in FIG. 1, FIG. 2*a*, FIG. 2*b*, and FIG. 2*c* only.

Further, it is appreciated from the FIG. 1, FIG. 2*a*, FIG. 2*b*, and FIG. 2*c*, and the above description, summarily that according to the present invention, since the crankdisk 3 slides under hydrodynamic conditions inside the bearing ring 3A, which rolls or slides on the piston slot wall bearing surface 4, metal to metal high friction contact between the crankdisk and the piston slot wall is avoided with the proposed improvements. While a bearing ring and three specific designs for holding the bearing ring in its designed position, when the crankdisk rotates, have been proposed in the referenced prior art, the specific design and requirements, which eliminate dedicated piston connecting structures, as presented above and in FIG. 2*a*, FIG. 2*b* and FIG. 2*c* have not been proposed for the Waissi Engine. The proposed design of the bearing ring and bearing ring assembly, with respect to assembly of the crankdisk-bearing ring-integrated piston assembly utilizing the piston head connecting members to hold the bearing ring in its designed position, function of the bearing in terms of the bearing ring staying in its designed position when the crankdisk rotates, summarily constitute a significant difference from the prior art for the Waissi Engine.

A bearing ring 3A substitution or replacement by other types of bearings or bearing rings which accomplish the same function do not constitute a different invention. With respect to assembly, bearing weight, dynamic engine balance, wear and tear, cost of bearings, and total cost of engine manufacture, the proposed solutions appear to be the simplest, most durable, and most cost effective.

What is claimed is:

1. An improved internal combustion engine, comprising: a driveshaft and means mounting the driveshaft for rotation about an axis; at least one pair of aligned and opposed cylinders; at least one double-headed piston, having at least one rigid connection between the piston heads, reciprocating in said pair of cylinders; a circular crankdisk, for each said piston respectively, installed on said driveshaft, and allowing for a small lateral movement of said crankdisk on said driveshaft; the said crankdisk having an outer annular surface formed about a center that is laterally offset from the center of rotation of the said driveshaft, and attached to the said driveshaft; the said piston body having a first slot, a second slot perpendicular to the first slot, each of said slots being perpendicular to the axis of the driveshaft and the crankdisk, the first slot being perpendicular to the piston axis and allowing the rotating movement of the driveshaft, and the second slot allowing the rotating movement of the crankdisk; a flat I-profile bearing ring, mounted on the annular surface of the said crankdisk, which engages slidably under hydrodynamic conditions the annular surface of the said crankdisk, and rolls or slides against the inside walls of the said second slot linear bearing surface provided axially through the double-headed piston;

wherein the improvement comprises of the piston head connecting members, or structures, attached to both side substructures of the linear bearing surfaces of the two piston heads, serving a dual function by, first, forming a rigid, integrated, double-headed piston assembly, and second, by serving, without grooves or flanges, as side support for the bearing ring;

whereby the said bearing ring and said bearing ring-crankdisk assembly, allowing for a small lateral movement of the said crankdisk and the said bearing ring, fit in-between the said connecting members, which, without grooves or flanges, keep the bearing ring in its designed place when the crankdisk rotates;

whereby the said crankdisk with the aid of the said bearing ring transmits the piston force of the double-headed piston to the driveshaft and causes the driveshaft to rotate about its axis.

* * * * *